US007961553B2

(12) United States Patent
Kang

(10) Patent No.: US 7,961,553 B2
(45) Date of Patent: Jun. 14, 2011

(54) SENSORY SIGNAL OUTPUT APPARATUS

(75) Inventor: Yun Gyu Kang, Gyeonggi-do (KR)

(73) Assignee: Yea Il Electronics Co., Ltd., Incheon (KR)

( * ) Notice: Subject to any disclaimer, the term of this patent is extended or adjusted under 35 U.S.C. 154(b) by 471 days.

(21) Appl. No.: 11/989,816

(22) PCT Filed: Mar. 14, 2007

(86) PCT No.: PCT/KR2007/001806

§ 371 (c)(1),
(2), (4) Date: Mar. 6, 2008

(87) PCT Pub. No.: WO2008/111700

PCT Pub. Date: Sep. 18, 2008

(65) Prior Publication Data

US 2010/0103778 A1 Apr. 29, 2010

(30) Foreign Application Priority Data

Mar. 14, 2007 (KR) ..... 10-2007-0024889

(51) Int. Cl.
*H04R 9/02* (2006.01)

(52) U.S. Cl. ..... 367/183; 367/182; 381/151

(58) Field of Classification Search ..... 367/182–187; 381/151

See application file for complete search history.

(56) References Cited

U.S. PATENT DOCUMENTS

| | | | | |
|---|---|---|---|---|
| 4,829,581 | A * | 5/1989 | Nieuwendijk et al. | 381/398 |
| 6,208,237 | B1 * | 3/2001 | Saiki et al. | 381/151 |
| 6,466,682 | B2 * | 10/2002 | An | 381/413 |
| 6,668,065 | B2 | 12/2003 | Lee et al. | |
| 6,839,443 | B2 | 1/2005 | Fukuda | |
| 7,110,564 | B2 * | 9/2006 | Son | 381/151 |
| 2003/0036364 | A1 * | 2/2003 | Chung | 455/90 |
| 2006/0098829 | A1 * | 5/2006 | Kobayashi | 381/151 |
| 2006/0165246 | A1 * | 7/2006 | Lee et al. | 381/151 |
| 2006/0262954 | A1 | 11/2006 | Lee et al. | |

FOREIGN PATENT DOCUMENTS

WO WO-2004/032566 4/2004

* cited by examiner

*Primary Examiner* — Ian J Lobo

(74) *Attorney, Agent, or Firm* — Kile Park Goekjian Reed & McManus PLLC

(57) ABSTRACT

The present invention provides a sensory signal output apparatus, which is constructed such that several frequencies of output can be realized. The sensory signal output apparatus includes a coil (15), to which an alternating signal is transmitted, a magnetic circuit (11) including a magnet (1 Ia), a top plate (1 Ib) and a yoke (1 Ic) to form an opening such that magnetic flux linkage perpendicular to the coil is induced, and a casing (1) receiving the magnetic circuit therein. The sensory signal output apparatus further includes a first vibration unit (10*a*) having the magnetic circuit, which responds to a magnetic field depending on a direction of the input signal, thus vibrating, and a first vibrating screen (13) adhered or welded to a ring-shaped protrusion of the yoke, thus generating a sensory signal. The sensory signal output apparatus further includes a second vibration unit (10*b*), which is vibrated by the coil, which repels and thus vibrates relative to the magnetic circuit, thus generating a sensory signal.

20 Claims, 9 Drawing Sheets

SENSORY SIGNAL OUTPUT APPARATUS

TECHNICAL FIELD

The present invention relates, in general, to sensory signal output apparatuses and, more particularly, to a sensory signal output apparatus, such as a speaker, a receiver, a vibrator, etc., which converts an electric signal, input from a signal source, into a mechanical signal to output sounds or generate vibrating force.

BACKGROUND ART

As well known to those skilled in the art, sensory signal output apparatuses are classified into sound generating apparatuses, such as speakers, receivers and buzzers, which output voices and sounds, and vibration generating apparatuses, which generate vibration force as well as sounds to output sounds in multiple frequencies.

Here, a speaker (or a receiver) is an apparatus that converts an input frequency signal into sound and outputs the sound. In the speaker, electric energy is converted into mechanical energy by a voice coil, provided in an opening defined in the speaker, using Fleming's left-hand rule, in which, when a conductor through which electric current flows is placed in a magnetic field, a thrusting force is applied thereto.

In detail, when current signals including several frequencies are applied to the voice coil, the voice coil generates mechanical energy depending on the intensity of electric currents and the magnitude of frequency and vibrates a vibrating screen attached to the voice coil, thus generating sound pressure waves having a predetermined frequency perceptible by the ears of humans.

Of such apparatuses for generating sound pressure, an apparatus that generates relatively low sound pressure and is used in a state of being close to the ear of a human is called a receiver, and an apparatus that generates relatively low sound pressure and is used in a state of being spaced apart from the ear of a human by a predetermined distance is called a speaker.

In the speaker, a magnetic circuit is constructed such that magnetic flux linkage, perpendicular to a voice coil placed in an opening, is induced using a magnet (a permanent magnet) and a top plate in a yoke made of iron metal. The voice coil, which is adhered to a vibrating screen, generates excitation force in response to an input signal, and thus vibrates the vibrating screen, which is attached to a frame, thus generating sound pressure.

The vibrating screen has various shapes of waves to ensure superior responsiveness and to prevent a buckling phenomenon when it vertically vibrates. This shape of the vibrating screen acts as a critical design variable that influences frequency characteristic.

Such speakers have not greatly changed in structure for many years, but, recently, thanks to the commercialization of high-energy permanent magnets and the development of techniques for forming fine structures, and to satisfy the trend towards lightness and compactness in the information and communication field, lightness and compactness and high performance of speakers have been realized. Despite developments in the technique, the compactness of electric-acoustic transducers and electronic devices having the electric-acoustic transducers limits the output of speakers. This remains as a technical problem in this art.

Furthermore, in the case of a speaker device, which outputs sounds at several levels, that is, low tones, middle tones and high tones, to improve the quality of sound, because several speakers are installed in a cabinet having a box shape, there is a disadvantage in that the volume thereof is increased.

In addition, recently, an electric-acoustic transducer, in which two magnetic circuits and vibration structures are provided in a single frame, was proposed. However, in the conventional electric-acoustic transducer, because vibration structures are oriented in opposite directions, when the vibration structures are operated at the same time, the vibrating forces of the vibration structures offset each other. As a result, there is a problem in that the efficiency of output, relative to an input signal or to the amount of power consumed, is reduced.

DISCLOSURE OF INVENTION

Technical Problem

Accordingly, the present invention has been made keeping in mind the above problems occurring in the prior art, and an object of the present invention is to provide a sensory signal output apparatus, which is constructed such that several frequencies of output can be gained from a single magnetic circuit at the same time, that is, a multiple output (2-way or 3-way type) can be gained.

Technical Solution

In order to accomplish the above object, the present invention provides a sensory signal output apparatus, including: a coil, to which an alternating signal is transmitted; a magnetic circuit, including a magnet, a top plate and a yoke to form an opening such that magnetic flux linkage perpendicular to the coil is induced; and a casing, receiving the magnetic circuit therein, the sensory signal output apparatus further comprising: a first vibration unit including the magnetic circuit, which is constructed such that, when an alternating signal is input into the coil, the magnetic circuit responds to a magnetic field depending on the direction of the input signal, thus vibrating, and a first vibrating screen made of a thin sheet and adhered or welded to the upper end of a ring-shaped protrusion of the yoke, thus vibrating along with the magnetic circuit, thereby generating a sensory signal; and a second vibration unit vibrated by the coil, vibrating to repel the magnetic circuit, thus generating a sensory signal.

In the present invention, having the above-mentioned construction, while magnetic flux linkage is induced perpendicular to the coil, which is placed in the opening defined between the yoke made of iron metal and the magnet and the top plate, the direction of force is changed depending on the direction in which a signal is input into the coil, so that the magnetic circuit, including the yoke, the magnet, and the top plate, vibrates. At this time, the first vibration unit, including the magnetic circuit and a vibrating screen, vibrates and thus generates sounds or vibrations. Here, because the weight of the first vibration unit is relatively large, the amplitude thereof is relatively large, so that bass sounds are generated.

Meanwhile, when the magnet circuit, which is a layered structure comprising the magnet, the top plate and the yoke, vibrates along with the first vibration unit, the coil, reacting to the vibrating force, vibrates itself and the second vibration unit, thus generating a sensory signal. Here, because the second vibration unit is relatively light compared to the first vibration unit, the amplitude thereof is also smaller than that of the first vibration unit, thus generating a relatively high tone.

Advantageous Effects

The sensory signal output apparatus according to the present invention can gain various levels of output from a single magnetic circuit, that is, can gain multiple output. Therefore, there is a functional advantage in that, despite having a simple and slim construction, superior quality of output is ensured.

BRIEF DESCRIPTION OF THE DRAWINGS

The above and other objects, features and advantages of the present invention will be more clearly understood from the following detailed description taken in conjunction with the accompanying drawings, in which.

BEST MODE FOR CARRYING OUT THE INVENTION

Hereinafter, the present invention will be described in detail with reference to the attached drawings.

Figure 1:
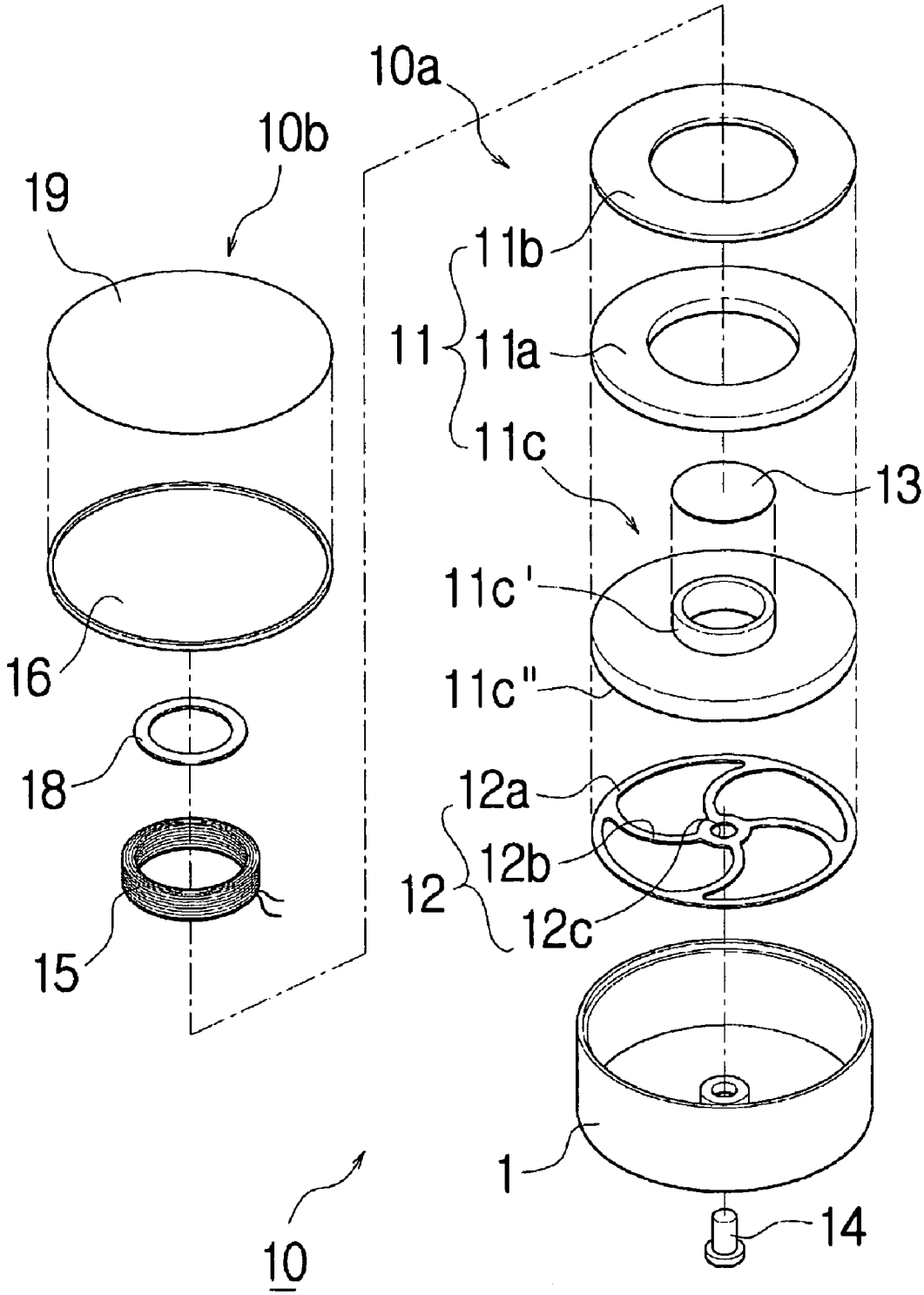
FIG. 1 is an exploded perspective view showing the construction according to a first embodiment of the present invention.
Figure 2:
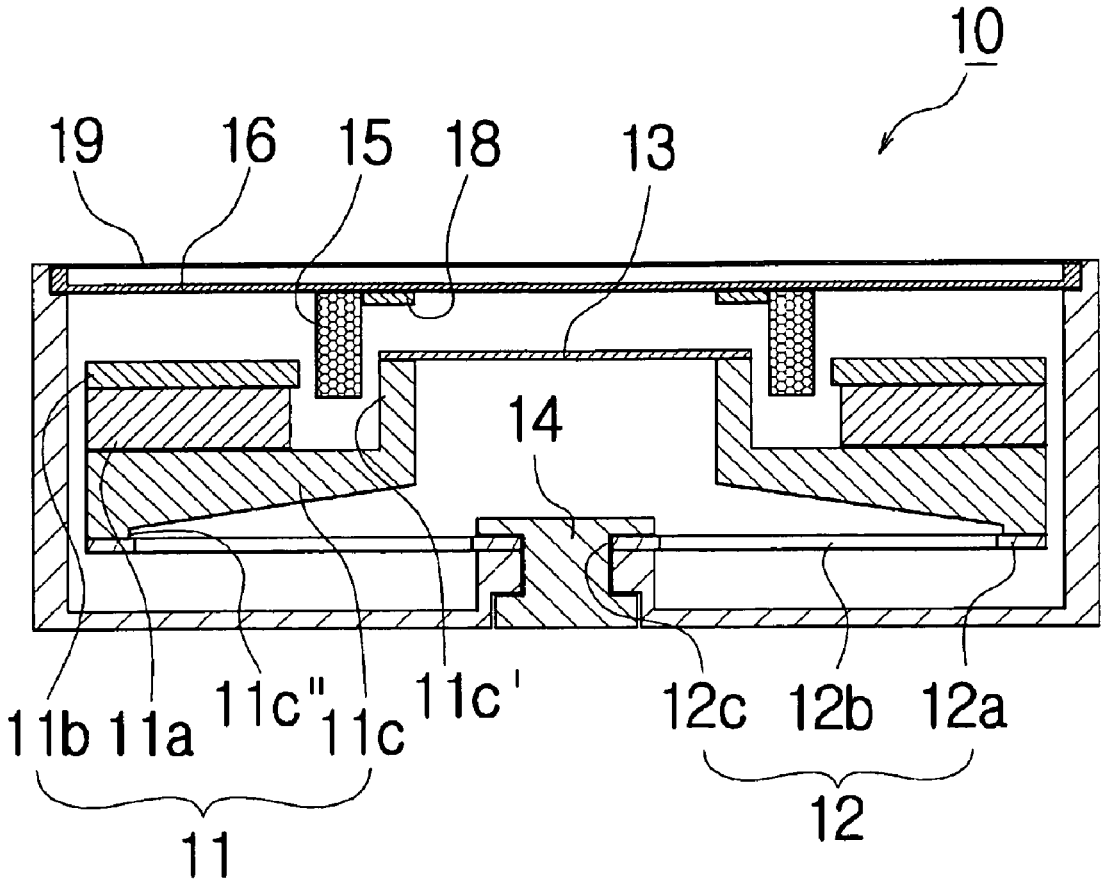
FIG. 2 is a sectional view showing the construction according to the first embodiment of the present invention.
Figure 3:
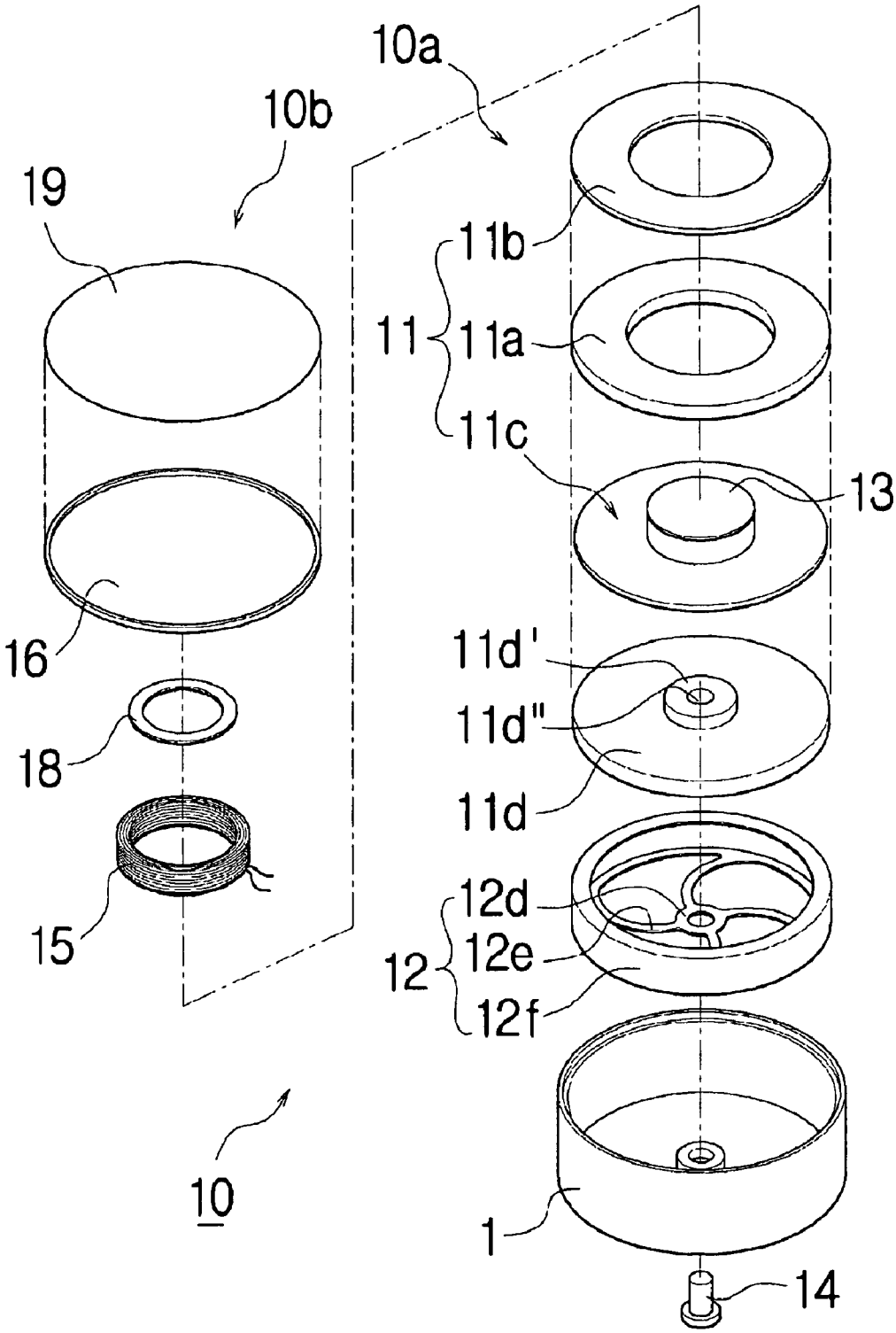
FIG. 3 is an exploded perspective view showing the construction according to a modification of the first embodiment of the present invention.
Figure 4:
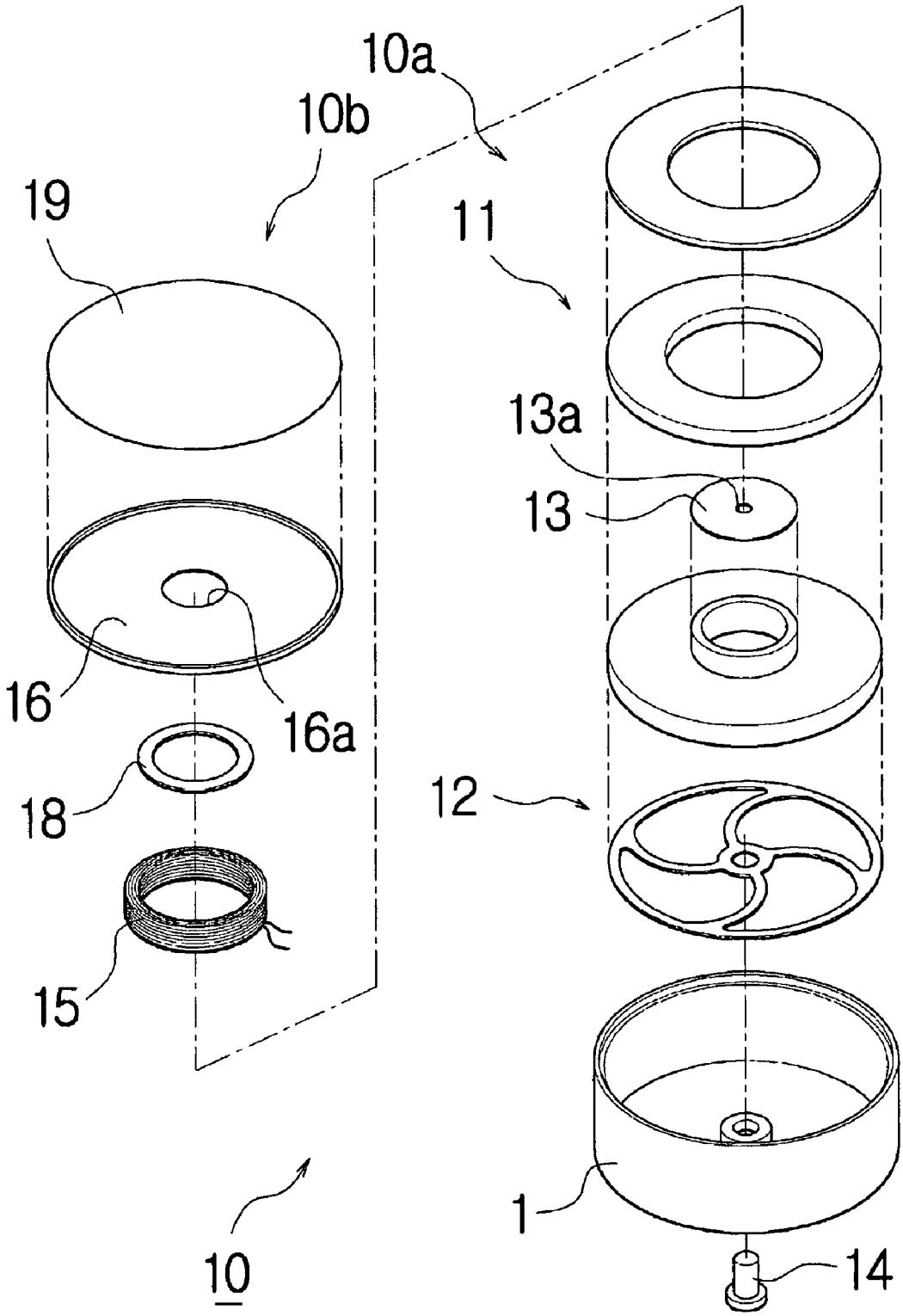
FIG. 4 is an exploded perspective view showing the construction according to another modification of the first embodiment of the present invention.
Figure 5:
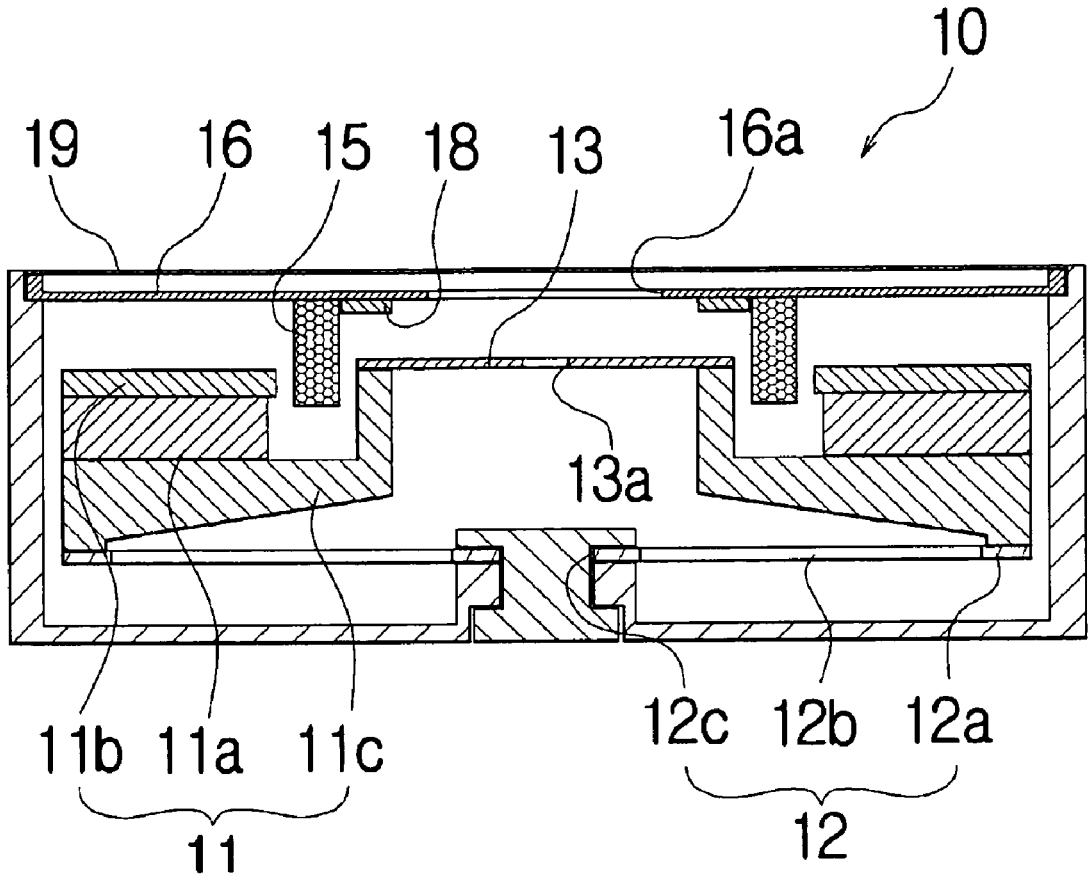
FIG. 5 is a sectional view showing in detail the construction of FIG. 4.
Figure 6:
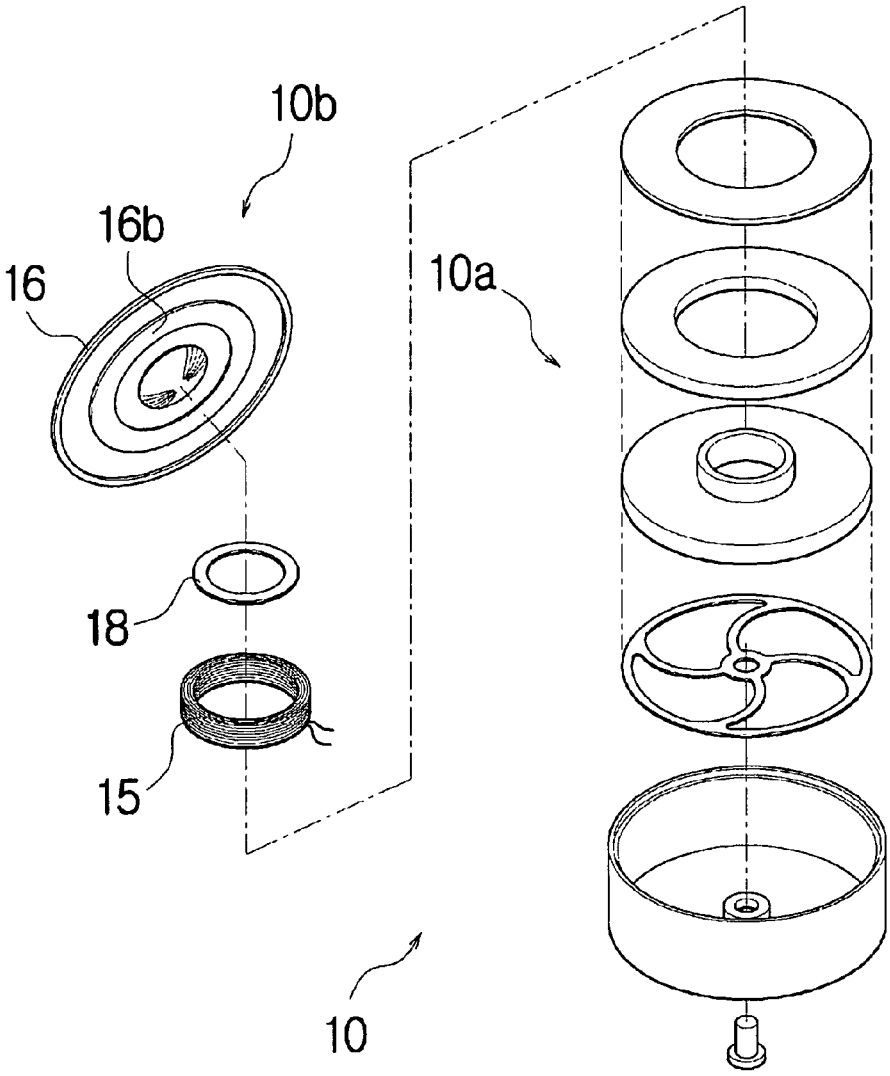
FIG. 6 is an exploded perspective view showing the construction according to a second embodiment of the present invention.
Figure 7:
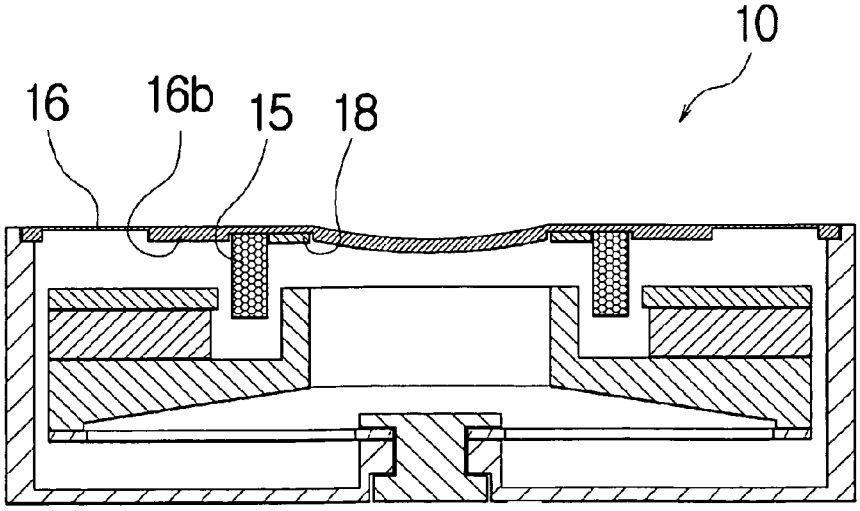
FIG. 7 is a sectional view showing in detail the construction of FIG. 6.
Figure 8:
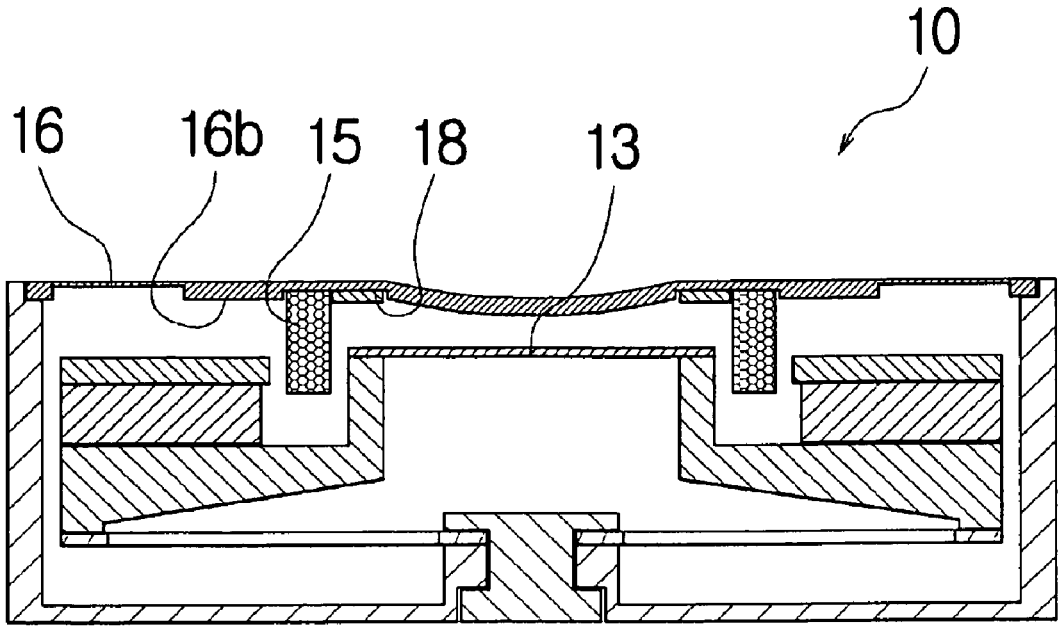
FIG. 8 is a sectional view showing a modification of the construction of FIG. 6.
Figure 9:
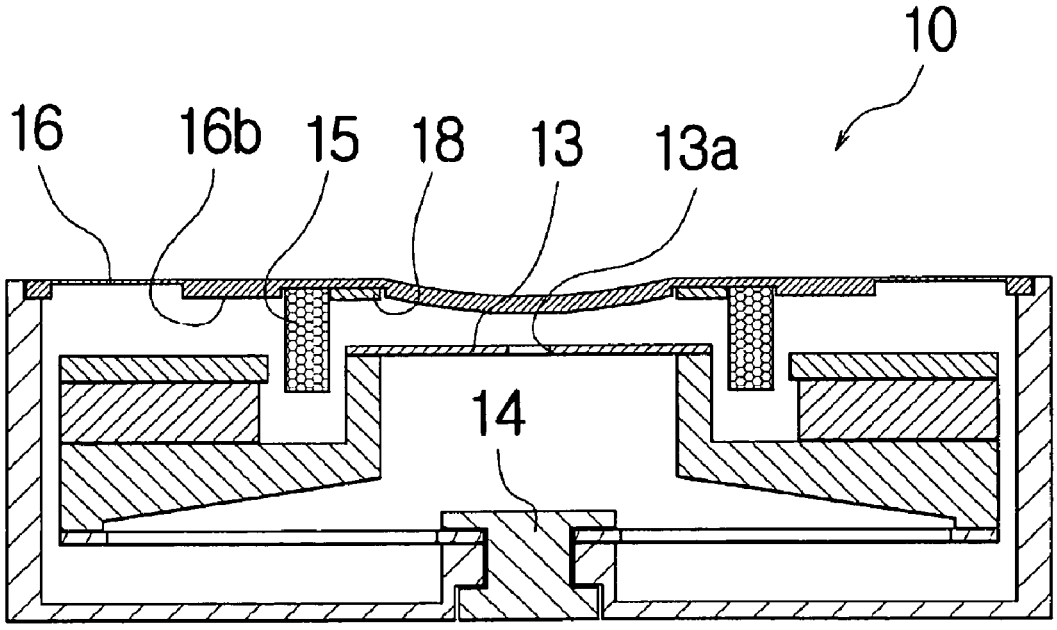
FIG. 9 is a sectional view showing another modification of the construction of FIG. 6.
Figure 10:
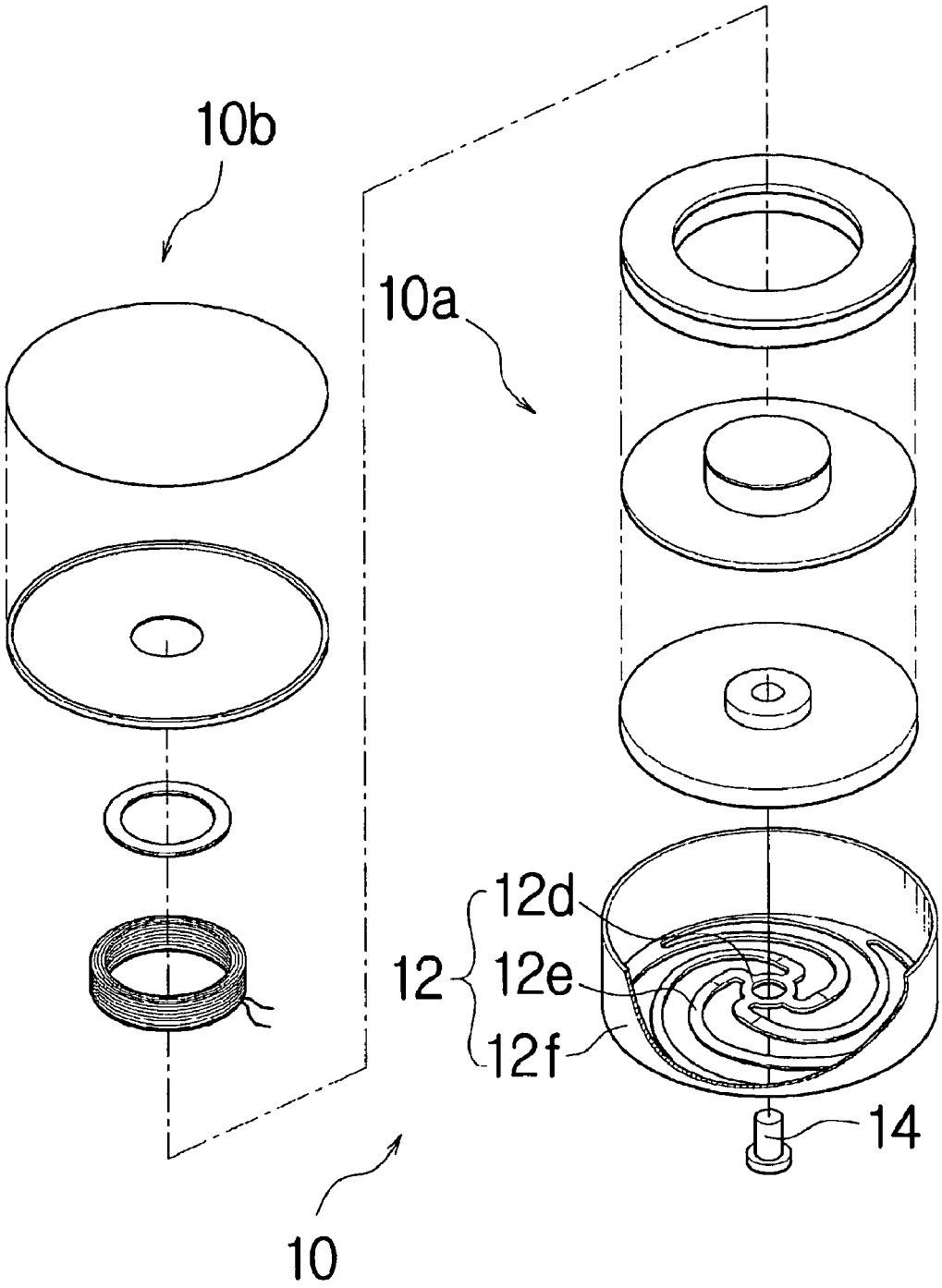
FIG. 10 is an exploded perspective view showing the construction according to a third embodiment of the present invention.
Figure 11:
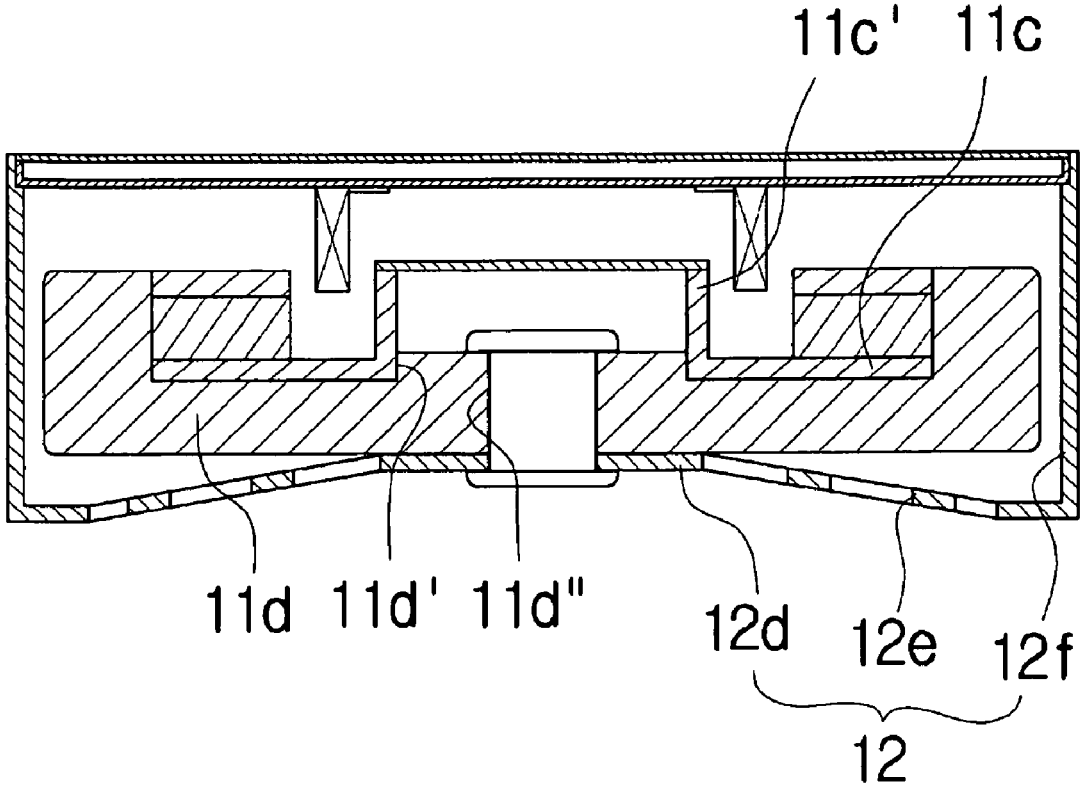
FIG. 11 is a sectional view showing in detail the construction of FIG. 10.

FIG. 1 is an exploded perspective view showing the construction according to a first embodiment of the present invention. FIG. 2 is a sectional view showing the construction according to the first embodiment of the present invention. FIG. 3 is an exploded perspective view showing the construction according to a modification of the first embodiment of the present invention. FIG. 4 is an exploded perspective view showing the construction according to another modification of the first embodiment of the present invention. FIG. 5 is a sectional view showing in detail the construction of FIG. 4. FIG. 6 is an exploded perspective view showing the construction according to a second embodiment of the present invention. FIG. 7 is a sectional view showing in detail the construction of FIG. 6. FIG. 8 is a sectional view showing a modification of the construction of FIG. 6. FIG. 9 is a sectional view showing another modification of the construction of FIG. 6. FIG. 10 is an exploded perspective view showing the construction according to a third embodiment of the present invention. FIG. 11 is a sectional view showing in detail the construction of FIG. 10.

First, as shown in FIGS. 1 and 2, a sensory signal output apparatus 10 according to the first embodiment of the present invention comprises a coil 15, to which an alternating signal is transmitted; a magnetic circuit 11, which includes a magnet 11*a*, a top plate 11*b* and a yoke 11*c*, to form an opening such that magnetic flux linkage perpendicular to the coil 15 is induced; and a casing 1, which receives the magnetic circuit 11 therein. The sensory signal output apparatus 10 further comprises a first vibration unit 10*a*, which includes the magnetic circuit 11, which is constructed such that, when an alternating signal is input into the coil 15, it responds to a magnetic field depending on the direction of the input signal, and a first vibrating screen 13, which is made of a thin sheet and is adhered or welded to the upper surface of a ring-shaped protrusion 11*c*' of the yoke 11*c*. Thus, the first vibration unit 10*a* vibrates along with the magnetic circuit 11, thereby generating a sensory signal. The sensory signal output apparatus 10 further comprises a second vibration unit 10*b*, which is vibrated by the coil 15 that vibrates and repels the magnetic circuit 11, thus generating a sensory signal.

The first vibration unit 10*a* may further include a spring 12, which elastically supports the magnetic circuit 11 in free space defined in the casing 1.

Here, for example, a ring-shaped permanent magnet, which generates magnetic force, may be used as the magnet 11*a* constituting the magnetic circuit 11. The top plate 11*b* may be made of a metal piece having a ring shape, and may be fastened to one surface of the magnet 11*a* to thus orient the magnetic force generated by the magnet 11*a* in one direction. The yoke 11*c* may be made of an iron plate, which has a through hole in the central portion thereof, and may be provided with the ring-shaped protrusion 11*c*' that protrudes in one direction from the edge of the through hole. Furthermore, the rear surface of the yoke 11*c* protrudes in a direction opposite the direction in which the ring-shaped protrusion protrudes, and is inclined towards the circumferential outer edge thereof, and a circumferential edge protrusion 11*c*" is provided under the circumferential outer edge of the rear surface of the yoke 11*c*. In addition, the magnet 11*a* is seated on the surface of the yoke 11*c*, on which the ring-shaped protrusion 11*c*' is provided, such that the magnet 11*a* is radially spaced apart from the ring-shaped protrusion 11*c*' by a predetermined distance to form the opening therebetween.

In the present invention, the construction of the magnetic circuit 11 is not limited to the above-mentioned construction. Furthermore, the installation position of the magnet 11*a* and the top plate 11*b* is not limited to the upper surface of the yoke 11*c*. For example, the magnet 11*a* and the top plate 11*b* may have circular block shapes, and the ring-shaped protrusion 11*c* of the yoke 11*c* may be provided on the circumferential outer edge thereof.

Meanwhile, as shown in FIG. 3, a weight member 11*d*, which serves to enhance vibration force using its weight when the magnet circuit 11 vibrates, may be further provided in the magnet circuit 11.

Here, in the drawing, the weight member 11*d* is illustrated as being a circular plate made of tungsten material and as including a central protrusion 11*d*', which is in close contact with the circumferential inner surface of the ring-shaped protrusion 11*c*' of the yoke 11*c*, and a through hole 11*d*", which is formed through the central protrusion 11*d*'.

However, the present invention is not limited to this construction. For example, the weight member 11*d* may be fastened to only one surface of the yoke 11*c*, and may have the same shape as the yoke 11*c*. In other words, the weight member 11*d* may have a shape such that a through hole is formed through the central portion thereof, a ring-shaped protrusion protrudes in one direction from the edge of the through hole, a rear surface thereof protrudes in the opposite direction and is inclined towards the circumferential outer edge thereof, and a circumferential edge protrusion is provided under the circumferential outer edge of the rear surface.

The spring 12 may include a mounting part 12*a*, on which the circumferential edge protrusion 11*c*" of the yoke 11*c* is seated, a plurality of elastic support ribs 12*b*, which radially extend from the mounting part 12*a* inwards and elastically support the magnetic circuit 11 including the yoke 11*c*, and a through hole 12*c*, which is formed through a central part, at which the elastic support ribs 12*b* are joined together.

Here, the spring 12 is made of a metal plate having a single body. Furthermore, the spring 12 may be fastened to the casing 1 by tightening a locking member 14, such as a rivet, a screw or an elastic pin, into the casing 1 and the through hole 12*c* of the spring 12. Alternatively, the spring 12 may be fastened to the casing 1 by welding or by bonding. In the first embodiment, the spring 12 is illustrated as being fastened to the casing 1 using a rivet.

In detail, the spring 12 is placed in the casing 1 and, thereafter, the rivet passes through the center of the casing 1 and protrudes upwards through the through hole 12*c* of the spring 12. Subsequently, the part of the rivet that protrudes from the spring 12 is riveted, thus reliably fastening the spring 12 to the casing 1.

Here, each elastic support rib 12*b* of the spring 12 may have a linear shape that defines a minimum length or, alternatively, may have a curved shape (a spiral shape) or a zigzag shape to extend the length thereof such that the elastic range can be increased. In the first embodiment, the elastic support rib 12*b* is illustrated as having a curved shape, that is, a spiral shape.

Furthermore, as shown in FIG. 3, the spring 12 may have a structure such that a circumferential outer edge part is bent upwards and thus holds the circumferential outer edges of the yoke 11*c*, the magnet 11*a* and the top plate 11*b*, thereby assembling the magnetic circuit 11 without requiring a separate bonding process.

In addition, in the first vibration unit 10*a*, the first vibrating screen 13, which is made of a synthetic resin or a metal thin sheet, is adhered or welded to the upper end of the ring-shaped protrusion 11*c*' of the yoke 11*c*. Thus, the first vibrating screen 13, along with the magnetic circuit 11, vibrates and generates vibration force and simultaneously generates sounds.

Here, in the case of the first vibration unit 10*a*, because the weight of the magnetic circuit 11 is relatively large, the amplitude of vibration is relatively large, so that bass sounds are output, and the frequency thereof ranges from approximately 20 Hz to approximately 800 Hz.

Meanwhile, in the present invention, the second vibration unit 10*b* may include the coil 15, which vibrates in the free space defined in the opening of the magnetic circuit 11, and a second vibrating screen 16, to the central portion of one surface of which the coil 15 is fastened, and which is supported by the casing 1.

In detail, in the second vibration unit 10*b*, the coil 15 is bonded to the central portion of the second vibrating screen 16, which is made of a synthetic resin sheet that is thinner than that of the first vibration unit 10*a*. Furthermore, the circumferential outer edge of the second vibration unit 10*b* is fastened to the edge of the open end of the casing 1 by bonding.

In this construction, while the magnetic circuit 11 vibrates, the second vibrating screen 16 is vibrated by the repulsive force of the coil 15, which responds to the magnetic field formed in the opening of the magnetic circuit 11, thus generating sounds. At this time, the amplitude of vibration of the second vibrating screen 16 is less than that of the first vibrating screen 13, so that the frequency thereof is relatively high, that is, it ranges from approximately 500 Hz to approximately 4 kHz.

In addition, the second vibration unit 10*b* may further include a magnetic substance 18, which is provided around the circumferential inner surface or the circumferential outer surface of the coil 15, which is provided at the central portion of the second vibration unit 10*b*. Here, the magnetic substance 18 may be made of a metal body, which is magnetized by reaction to magnetic force, or may be a magnet. Furthermore, the magnetic substance 18 may be fastened to the second vibrating screen 16, to which the coil 15 is fastened, by bonding or impregnation.

In this construction, when no alternating signal is input into the coil 15, magnetic force is applied between the second vibration unit 10*b* and the magnet 11*a*, the top plate 11*b* and the yoke 11*c*, and thus they attract each other. When an alternating signal is input into the coil 15, the input signal and the magnetic force of the magnetic substance 18 complement each other, thus further increasing vibration force.

Furthermore, as shown in FIGS. 4 and 5, the second vibrating screen 16 of the second vibration unit 10*b* may have an open hole 16*a* in the central portion thereof to ensure smooth vibration. Of course, the first vibrating screen 13 of the first vibration unit 10*a* may also have an open hole 13*a* in the central portion thereof.

As well, the second vibration unit 10*b* may further include a third vibrating screen 19, which is fastened to the edge of the open end of the casing 1 such that it is spaced apart from the outer surface of the second vibrating screen 16 by a predetermined distance.

In this case, when air is vibrated by the first and second vibrating screens 13 and 16, the third vibrating screen 19 vibrates at a relatively small amplitude of vibration compared to the first and second vibrating screens 13 and 16, thus generating sounds. Here, the frequency of the third vibrating screen 19 ranges from 4 kHz to 20 kHz.

In the present invention, having the above-mentioned construction, while magnetic flux linkage is induced perpendicular to the coil 15, which is placed in the opening defined between the yoke 11*c* made of iron metal and the magnet 11*a* and the top plate 11*b*, the direction of force is changed depending on the direction in which a signal is input from an outside sound source generating unit to the coil 15, so that the magnetic circuit 11, including the magnet 11*a*, the top plate 11*b* and the yoke 11*c*, vibrates, and the first vibration unit 10*a* thus generates vibrating force. At this time, in the case where the first vibrating screen 13 is provided on the end of the magnetic circuit 11, the first vibrating screen 13 vibrates along with the magnetic circuit 11, thus generating sounds having frequencies ranging from 20 Hz to 800 Hz.

Meanwhile, when the magnet circuit 11 including the magnet 11*a* and the top plate 11*b* and the yoke 11*c* vibrates, the coil 15, reacting to the vibrating force of the magnet circuit 11, vibrates itself and vibrates the second vibrating screen 16 constituting the second vibration unit 10*b*, thus generating sounds having frequencies ranging from 50 Hz to 4 kHz.

Furthermore, when air vibrates due to the vibration of the first and second vibration units 10*a* and 10*b*, the third vibrating screen 19 vibrates due to the vibration of air, thus generating sounds having frequencies ranging from 4 kHz to 20 kHz.

Although the construction and operation according to the first embodiment of the present invention have been disclosed for illustrative purposes, as shown in FIGS. 6 and 7, as the second embodiment, the present invention may be constructed such that a central portion of a second vibrating screen 16 of a second vibration unit 10*b* is curved and includes a reinforcing surface 16*c*, which is thicker than the perimeter of the second vibrating screen 16.

In this case, when the second vibrating screen 16 vibrates, the second vibrating screen 16 is prevented from being twisted by the weight of a coil 15 and a magnetic substance 18, thus generating stable output.

Of course, in the case of the second embodiment, a first vibrating screen 13 may be provided in a magnetic circuit 11, and an open hole 13*a* is formed through the central portion of the first vibrating screen 13, in the same manner as those of the prior embodiment. These are clearly illustrated in the FIGS. 8 and 9.

Meanwhile, as shown in FIGS. 10 and 11, in the third embodiment of the present invention, a spring 12 may include a second mounting part 12*d*, onto which the magnetic circuit 11 is seated, a plurality of second elastic support ribs 12*e*, which radially extend outwards from the second mounting part 12*d* and are inclined downwards to elastically support the magnetic circuit 11, and a casing part 12*f*, which connects the outer ends of the second elastic support ribs 12*e* to each other and extends a predetermined height upwards from the circumferential outer edge part, connecting the outer ends of the second elastic support ribs 12*e* to surround the magnetic circuit 11 seated on the second mounting part 12*d*.

Here, the reason why the second elastic support rings 12*e* of the spring 12 are inclined downwards is so that the amplitude of vibration of the spring 12 can be increased and, in particular, the spring 12 can vibrate without protruding outside the casing part 12*f*.

The present invention having the above-mentioned construction may be used as a bone conduction speaker or earphone, a typical speaker, or a receiver earphone, and may also be used as a vibrator.

Although the preferred embodiments of the present invention have been disclosed for illustrative purposes, the present invention is not limited to the construction and operation of the illustrated embodiments. Furthermore, those skilled in the art will appreciate that various modifications, additions and substitutions are possible, without departing from the scope and spirit of the invention as disclosed in the accompanying claims. Therefore, the modifications, additions and substitutions must be regarded as falling within the bounds of the present invention.

INDUSTRIAL APPLICABILITY

As described above, the present invention can gain various levels of output from a single magnetic circuit, that is, can realize multiple output. Therefore, there is a functional advantage in that, despite having a simple and slim construction, superior quality of output is ensured.

The invention claimed is:

1. A sensory signal output apparatus, comprising:

a coil generating a magnetic field in response to an alternating signal input to the coil;

a magnetic circuit, including a magnet, a top plate and a yoke, to form an opening such that magnetic flux linkage is induced perpendicular to the coil;

a casing receiving the magnetic circuit therein;

a first vibration unit comprising the magnetic circuit and a first vibrating screen, the first vibration screen vibrating in response to said magnetic field depending on a direction of the input signal, the first vibrating screen made of a thin sheet and adhered or welded to an upper end of a ring-shaped protrusion of the yoke, wherein vibration of the first vibrating screen generates a first sensory signal; and a second vibration unit comprising the coil and a second vibrating screen, the second vibration unit moving in repulsion to the magnetic circuit, wherein vibration of the second vibrating screen generates a second sensory signal.

2. The sensory signal output apparatus according to claim 1, wherein the first vibration unit further comprises a spring elastically supporting the magnetic circuit in a free space defined in the casing.

3. A sensory signal output apparatus, comprising:

a coil generating a magnetic field in response to an alternating signal input to the coil;

a magnetic circuit, including a magnet, a top plate and a yoke, to form an opening such that magnetic flux linkage is induced perpendicular to the coil;

a casing receiving the magnetic circuit therein;

a first vibration unit comprising the magnetic circuit and a first vibrating screen, the first vibration screen vibrating in response to said magnetic field depending on a direction of the input signal, the first vibrating screen made of a thin sheet and adhered or welded to an upper end of a ring-shaped protrusion of the yoke, wherein vibration of the first vibrating screen generates a first sensory signal; and a second vibration unit comprising the coil and a second vibrating screen, the second vibration unit moving in repulsion to the magnetic circuit, wherein vibration of the second vibrating screen generates a second sensory signal;

wherein the magnet constituting the magnetic circuit comprises a ring-shaped permanent magnet generating magnetic force, the top plate comprises a metal piece having a ring shape and fastened to one surface of the magnet to concentrate in one direction the magnetic force generated from the magnet, the yoke comprises an iron plate having a through hole in a central portion thereof and provided with the ring-shaped protrusion, the ring-shaped protrusion protruding in one direction from an edge of the through hole, a rear surface of the yoke protruding in a direction opposite the direction in which the ring-shaped protrusion protrudes and being inclined towards a circumferential outer edge thereof, and a circumferential edge protrusion is provided under the circumferential outer edge of the rear surface of the yoke, the magnet being seated onto the surface of the yoke on which the ring-shaped protrusion is provided, such that the magnet is radially spaced apart from the ring-shaped protrusion by a predetermined distance to form the opening therebetween.

4. The sensory signal output apparatus according to claim 2, further comprising:

a weight member provided in the magnetic circuit such that, when the magnetic circuit vibrates, vibrating force thereof is increased by a weight of the weight member.

5. The sensory signal output apparatus according to any one of claims 2, 3 and 4, wherein the weight member is a circular plate made of tungsten material and comprises: a central protrusion in close contact with a circumferential inner surface of the ring-shaped protrusion of the yoke, and a through hole formed through the central protrusion.

6. The sensory signal output apparatus according to claim 2, wherein the spring comprises: a first mounting part, on which the circumferential edge protrusion of the yoke is seated; a plurality of first elastic support ribs, radially extending inwards from the first mounting part and elastically supporting the magnetic circuit including the yoke; and a through hole formed through a central part, at which the first elastic support ribs are joined together.

7. The sensory signal output apparatus according to any one of claims 1 and 6, further comprising a locking member inserted into the through hole of the spring, the locking member fastening the spring to a central portion in the casing.

8. The sensory signal output apparatus according to claim 2, wherein the spring is bent at a circumferential outer edge thereof upwards to surround circumferential outer surfaces of the yoke, the magnet and the top plate, thus forming the magnetic circuit without requiring a separate bonding process.

9. The sensory signal output apparatus according to any one of claims 1 and 3, wherein the first vibrating screen of the first vibration unit is made of the thin sheet and is adhered or welded to the upper end of the ring-shaped protrusion of the yoke, wherein an open hole is formed through a central portion of the first vibrating screen to ensure smooth vibration thereof.

10. The sensory signal output apparatus according to claim 1, wherein the coil vibrates in a free space defined in the opening of the magnetic circuit, the second vibrating screen is supported by the casing, and the coil is fastened to a central portion of one surface of the second vibrating screen.

11. The sensory signal output apparatus according to claim 10, wherein the second vibration unit further comprises: a magnetic substance provided around a circumferential inner surface or a circumferential outer surface of the coil fastened to the central portion of the second vibration unit.

12. The sensory signal output apparatus according to claim 11, wherein the magnet is substance comprises a metal body to be magnetized by a magnetic force.

13. The sensory signal output apparatus according to claim 10, wherein the second vibrating screen of the second vibration unit has an open hole in a central position thereof to ensure smooth vibration thereof.

14. The sensory signal output apparatus according to claim 1, wherein the second vibration unit further comprises: a third vibrating screen fastened to an edge of an open end of the casing at a position spaced apart from an outer surface of the second vibrating screen by a predetermined distance.

15. The sensory signal output apparatus according to claim 10, wherein a central portion of the second vibrating screen of the second vibration unit is curved and includes a reinforcing surface that is thicker than a perimeter of the second vibrating screen.

16. The sensory signal output apparatus according to claim 2, wherein the spring comprises: a second mounting part, onto which the magnetic circuit is seated; a plurality of second elastic support ribs radially extending outwards from the second mounting part and inclined downwards to elastically support the magnetic circuit; and a casing part connecting outer ends of the second elastic support ribs to each other and extending a predetermined height upwards from the circumferential outer edge part connecting the outer ends of the second elastic support ribs to surround the magnetic circuit seated on the second mounting part.

17. The sensory signal apparatus according to claim 1, wherein the thin sheet of the first vibration screen has a substantial surface area at each of a first face and an opposite second face that is free to vibrate to generate an audio sensory signal.

18. The sensory signal apparatus according to claim 1, wherein the first vibration screen is located within a volume concentrically inward of the coil.

19. The sensory signal apparatus according to claim 1, wherein the first vibration screen and second vibration screen are positioned to be generally parallel with an uninterrupted, intervening air gap therebetween over a substantial surface area of a smaller of the first vibration screen and the second vibration screen.

20. The sensory signal apparatus according to claim 1, wherein the first vibration screen and second vibration screen are of differing dimensions and vibrate to different, partially overlapping, vibration ranges.

* * * * *